US012305471B2

(12) United States Patent
Eriksen

(10) Patent No.: US 12,305,471 B2
(45) Date of Patent: May 20, 2025

(54) PLUG ASSEMBLY WITH SLOPED WALLS

(71) Applicant: TCO AS, Indre Arna (NO)

(72) Inventor: Tommy Eriksen, Voss (NO)

(73) Assignee: TCO AS, Indre Arna (NO)

( * ) Notice: Subject to any disclaimer, the term of this patent is extended or adjusted under 35 U.S.C. 154(b) by 0 days.

(21) Appl. No.: 17/587,022

(22) Filed: Jan. 28, 2022

(65) Prior Publication Data

US 2023/0279736 A1 Sep. 7, 2023

(51) Int. Cl.
*E21B 33/12* (2006.01)
*E21B 17/10* (2006.01)

(52) U.S. Cl.
CPC ..... *E21B 33/1208* (2013.01); *E21B 17/1078* (2013.01)

(58) Field of Classification Search
CPC ..... E21B 33/1208; E21B 33/12; E21B 34/063
See application file for complete search history.

(56) References Cited

U.S. PATENT DOCUMENTS 5,303,774 A * 4/1994 Duhn ..... E21B 33/1212 166/322
5,479,986 A * 1/1996 Gano ..... E21B 23/04 166/292
10,465,445 B2 11/2019 Getzlaf et al.
2007/0012438 A1* 1/2007 Hassel-Sorensen ..... E21B 33/1208 166/250.08
2007/0163776 A1* 7/2007 Sorensen ..... E21B 33/12 166/179
2009/0101358 A1* 4/2009 Bjorgum ..... E21B 33/134 166/376
2012/0125631 A1* 5/2012 Entchev ..... E21B 33/12 166/376
2016/0060998 A1* 3/2016 Hiorth ..... E21B 33/12 166/192
2017/0203994 A1* 7/2017 Chen ..... B23K 26/402
2018/0290921 A1* 10/2018 Ahmed ..... C03C 21/002
2018/0313183 A1* 11/2018 Hiorth ..... E21B 33/134
2018/0334878 A1* 11/2018 Hiorth ..... E21B 33/134
2019/0017345 A1* 1/2019 Brandsdal ..... E21B 34/063
2019/0032448 A1* 1/2019 Bjørgum ..... E21B 34/063
2021/0017833 A1* 1/2021 Saraya ..... E21B 34/14

* cited by examiner

*Primary Examiner* — Theodore N Yao
(74) *Attorney, Agent, or Firm* — Flener IP & Business Law; Zareefa B. Flener

(57) ABSTRACT

Two examples of a glass assembly were claimed where the glass assembly includes a plug with a middle edge surface, wherein the middle edge surface contains the widest portion of the plug. In the first example middle edge surface is curved, and in the other example the middle edge surface is in contact with a stabilizer. A plug assembly was also claimed, including a glass assembly in a housing, a seat arranged to support the plug, a breaker object configured to break the plug, wherein the middle edge surface contains the widest portion of the plug; and wherein a stabilizer is arranged in contact with the middle edge surface.

19 Claims, 12 Drawing Sheets

PLUG ASSEMBLY WITH SLOPED WALLS

FIELD OF INVENTION

The present invention relates to a plug assembly for the temporary blocking of fluid flow through a downhole tubular. More specifically it relates to the shape of a plug and other components of the glass assembly in said plug assembly.

BACKGROUND

During the drilling, testing, completion, fracking, production and abandonment stages of hydrocarbon wells there are many uses for plugs assemblies that create a fluid barrier in the well. Some of these uses are not permanent such as plug and abandonment, but rather temporary, where it is desired to re-establish fluid flow at a later stage. Some examples of such temporary uses of plugs are for flotation, well testing during completion, packer setting and fluid loss devices. Temporary plugs may thus be installed in any kind of piping installed downhole, for example casing, liner, or other tubing. The only difference between these is the inner diameter of the pipe.

When flow through the well is to be established, the plug is broken. This preferably done without spearing, milling, or other mechanical intervention from the surface. Ways to achieve the desired breaking is through the use of pressure, pressure pulses, or explosives. When the plug is removed it allows for a nonrestricted fluid flow past the opened plug assembly, and for many applications after opening of the plug assembly this is required in order to pass various tools past the plug assembly.

Plugs can be made of various materials, such as metal, stone, or composites, or more frangible materials such as glass or ceramics. Frangible materials are often preferred as they have the advantage of being relatively insensitive to pressure, temperature and chemical corrosion, yet by their frangible nature they are relatively easy to destroy when used as the fluid blocking part of plug assemblies. Particularly glass, e.g. hardened glass, can be made to break into very small pieces that will not pose a problem in most wells. Frangible materials are therefore well suited for opening the plug assembly by constructing the plug assembly with a breaker of small amounts of explosives that will crush or shatter a glass disc, and open the plug assembly, but not damage the production tubing or casing the plug assembly is installed in. Plugs can also be opened by applying direct force thereto with a breaker. The breaker will then make contact with the plug on a relatively small area. Frangible materials will typically shatter, and this property of breaking under a large point pressure load is taken advantage of by employing a breaker object with a relatively small impact area, such as a thin edge like a knife blade, a point such as a pin, or even a small ball.

A problem with many frangible materials is that they can prematurely break where they contact a hard surface such as a metal surface. This can happen when the plug is being installed or even when changes in pressure in the well causes minute movements of the glass assembly. One way to overcome this issue is to put a bearing ring of a soft material (e.g. plastics such as polyether ether ketone; PEEK) between the frangible plug and any hard surface (e.g. steel) it abuts. This allows the force on the plug to be transferred to the bearing ring instead. The bearing ring will then compress and prevent the plug from coming in contact with a hard surface.

The plug should be installed in such a way that it is well secured, and will not break easily from fluctuating well pressures (i.e. from direct pressure rather than from a breaker). The plug should also be secured in such a way that it forms a as fluid tight seal as the specifications of the specific application require until it is removed. Leakage of fluid between the plug tubular and the surrounding area, such as the annulus, should be prevented as far as possible.

Loose parts in the wellbore can cause a lot of damage to equipment and even obstruct the well bore. Thus, the plug should preferably break into fragments small enough to not be a potential problem in the well. The various other parts of the plug assembly should preferably be prevented from entering the wellbore when breaking the plug, so they or pieces thereof will not be a potential problem in the well. These other parts should also preferably be prevented from moving once the plug assembly is opened. There should not be a possibility of a partial opening of the plug, i.e. the system should preferably only allow for the plug to be fully intact or fully broken, not partially broken. If partially broken, it would not be possible to open fully with pressure from above since a partially open plug assembly could not be pressurized, so different means to open it fully would have to be used.

The inner diameter of the tubing the plug assembly is installed in should preferably be fully restored upon opening of the plug assembly, i.e. the plug assembly should not have a smaller inner diameter than the inner diameter below and above the plug assembly. This allows for a nonrestricted fluid flow past the opened plug assembly, as well as unrestricted passing of tools up to the inner diameter of the pipe the plug sits in.

Advantages of the Present Invention

It is an object of the present invention to provide a plug assembly comprising a plug that can hold pressure while being used for its purpose, and then be safely and completely opened after it has served its purpose. Once open, the plug assembly parts should stay in place, and said parts or pieces thereof should not enter the wellbore.

It is an object of the present invention to provide a plug assembly comprising a plug that has an improved sealing of said plug before it is opened. Another object of the present invention is to provide a plug that is less likely to be prematurely broken during assembly, insertion into the well, or by movement of the plug tubular in the pipe (e.g. from movement or pressure changes in the pipe or formation). This is achieved by the geometries of the plug and/or stabilizer and/or glass assembly.

By the plug not having sharp corners, but rather rounded edges, it is less likely for said rounded edges to be chipped off during assembly, or when the plug experience relative movement against the surrounding components, such as when the plug is inserted into the well, or the plug housing shifts with the formation, or when the pressure applied from up hole or downhole or the formation changes.

Usually there is no bearing ring or stabilizer between a plug surface parallel with the plug housing and said housing or sleeve or whatever component the plug is to seal against. By adding the stabilizer, it helps stabilizing and centralizing the plug in place. If made of a softer material, similar to the materials the bearing rings are made of, it also helps cushion the side of the plug against any sideways impacts, and gives it a little extra play for movement. Rig operators are often concerned that frangible plugs are exposed to impacts and vibrations both during transport and operation, and therefore it is usually required that the plug assembly must be able to withstand shock and vibrations. Adding a stabilizer helps fill this requirement.

Not being bound to a specific theory, possible reasons for the improved sealing of the seals when on a surface not parallel to the plug housing but rather sloped is that the seals will receive less force than when on a surface parallel to the plug housing, such as at a parallel side of the plug. Such nonparallel surfaces may be better supported by the plug and housing. Thus, the seals may experience less force trying to push them out of the way. The seals would also have to move further, so it would take more force, to move them when on the sloped walls than when on a parallel, straight up and down wall. The pressure on the seals results in less of a risk of extrusion of said seals (e.g. O-rings), as the gap will be closed by the forces applied by the pressure. This may then lead to the seals being able to take higher pressure and leak less. This effect would be especially advantageous when the seals are also pressed up against the stabilizer, in which case this holds them well in place. Thus, this allows for better force distribution and reduced deformation of both seals and bearing rings under different pressures and temperatures to increase protection of the plug and form a better seal. The combination of the seals and the stabilizer provide an improved effect for both as they can help hold each other in place.

When the various parts for the glass assembly are made, they will of course be made to specifications, but there will usually be some variation in their manufacturing tolerances. This can cause assembly to be difficult, and the final seal to be not optimal. For example, if the components of the glass assembly are made slightly larger than specified, the seal will be very tight and the assembly hard to get into place. Likewise, if too small, the seal achieved may not have quite enough pressure on it from the components and may leak. The height adjustor addresses these problems. By loosening it, insertion of the glass assembly into its place in the housing is easy. When the glass assembly is put in place, the height adjustor can be adjusted so it applies just the right amount of pressure on the glass assembly, not too much pressure which could ultimately crack the plug or damage other components, and not too little pressure so the seal would be too loose and could leak, but just right to form a proper seal

SHORT SUMMARY OF THE INVENTION

In some aspects, the techniques described herein relate to a glass assembly including: a plug with an edge surface, the edge surface including a top edge surface, middle edge surface, and a bottom edge surface; wherein the middle edge surface contains the widest portion of the plug; and wherein the middle edge surface is curved.

In some aspects, the techniques described herein relate to a glass assembly, wherein the top edge surface or the bottom edge surface is a straight surface.

In some aspects, the techniques described herein relate to a glass assembly, wherein both the top edge surface and the bottom edge surface is a straight surface.

In some aspects, the techniques described herein relate to a glass assembly including: a plug with an edge surface, the edge surface including a top edge surface, middle edge surface, and a bottom edge surface; wherein the middle edge surface contains the widest portion of the plug; and wherein a stabilizer is arranged in contact with the middle edge surface.

In some aspects, the techniques described herein relate to a glass assembly, further including a sealing element in contact with the plug surface.

In some aspects, the techniques described herein relate to a glass assembly, further including a bearing ring in contact with the plug surface.

In some aspects, the techniques described herein relate to a glass assembly, further including a bearing ring and a sealing element, both in contact with the plug surface, wherein the sealing element is arranged between the bearing ring and the stabilizer.

In some aspects, the techniques described herein relate to a glass assembly, further including a first bearing ring, a second bearing ring, a first sealing element, and a second sealing element, all in contact with the plug surface, wherein: the first sealing element is arranged between the first bearing ring and the stabilizer; and the second sealing element is arranged between the second bearing ring and the stabilizer.

In some aspects, the techniques described herein relate to a glass assembly, wherein the middle edge surface is curved.

In some aspects, the techniques described herein relate to a glass assembly wherein the middle edge surface is curved.

In some aspects, the techniques described herein relate to a plug assembly including: a glass assembly, arranged in a housing the glass assembly including a plug with an edge surface, the edge surface including a top edge surface, middle edge surface, and a bottom edge surface; a seat arranged to support the plug; a breaker object configured to break the plug and wherein the middle edge surface contains the widest portion of the plug; and wherein a stabilizer is arranged in contact with the middle edge surface.

In some aspects, the techniques described herein relate to a plug assembly, wherein the middle edge surface is curved.

In some aspects, the techniques described herein relate to a plug assembly, wherein the stabilizer is not fluid tight.

In some aspects, the techniques described herein relate to a plug assembly, wherein glass assembly further includes a first bearing ring, a second bearing ring, a first sealing element, and a second sealing element, all in contact with the plug surface, wherein: the first sealing element is arranged between the first bearing ring and the stabilizer; and the second sealing element is arranged between the second bearing ring and the stabilizer.

In some aspects, the techniques described herein relate to a plug assembly wherein the seat 20 is arranged to move in axial direction toward the breaker object 30 when a threshold absolute pressure or threshold differential pressure is reached.

In some aspects, the techniques described herein relate to a plug assembly, further including a shear ring, the shear ring including a shear ring lip wherein the seat is supported by the shear ring lip; the end of the seat opposite of the glass assembly extends past the top of shear ring lip on the side toward the glass assembly.

In some aspects, the techniques described herein relate to a plug assembly, further including a breaker holder, wherein the breaker holder is configured to hold the breaker object fixed in place, and there is a seat pocket between the seat and the breaker assembly, where in the at least a portion of the seat enters a seat pocket, wherein: seat is in contact with the breaker object.

In some aspects, the techniques described herein relate to a plug assembly, further including a shear ring, the shear ring including a shear ring lip, wherein the seat is supported by the shear ring lip.

In some aspects, the techniques described herein relate to a plug assembly, further including a sealing area, wherein the sealing area is the region of the housing and seat in contact with the first sealing element and the second sealing element; and wherein, the sealing area is non-parallel with the axial axis of the plug assembly.

In some aspects, the techniques described herein relate to a plug assembly, further including a shear ring, the shear ring including a shear ring lip wherein the seat is supported by the shear ring lip; the end of the seat opposite of the glass assembly extends past the top of shear ring lip on the side toward the glass assembly.

BRIEF DESCRIPTION OF THE FIGURES

The above and further features of the invention are a set forth with particularity in the appended claims and advantages thereof will become clearer from consideration of the following detailed description. Embodiments of the present invention will now be described, by way of example only, with reference to the following diagrams wherein:

REFERENCE NUMBERS AND CORRESPONDING ELEMENTS

Figure 1A:
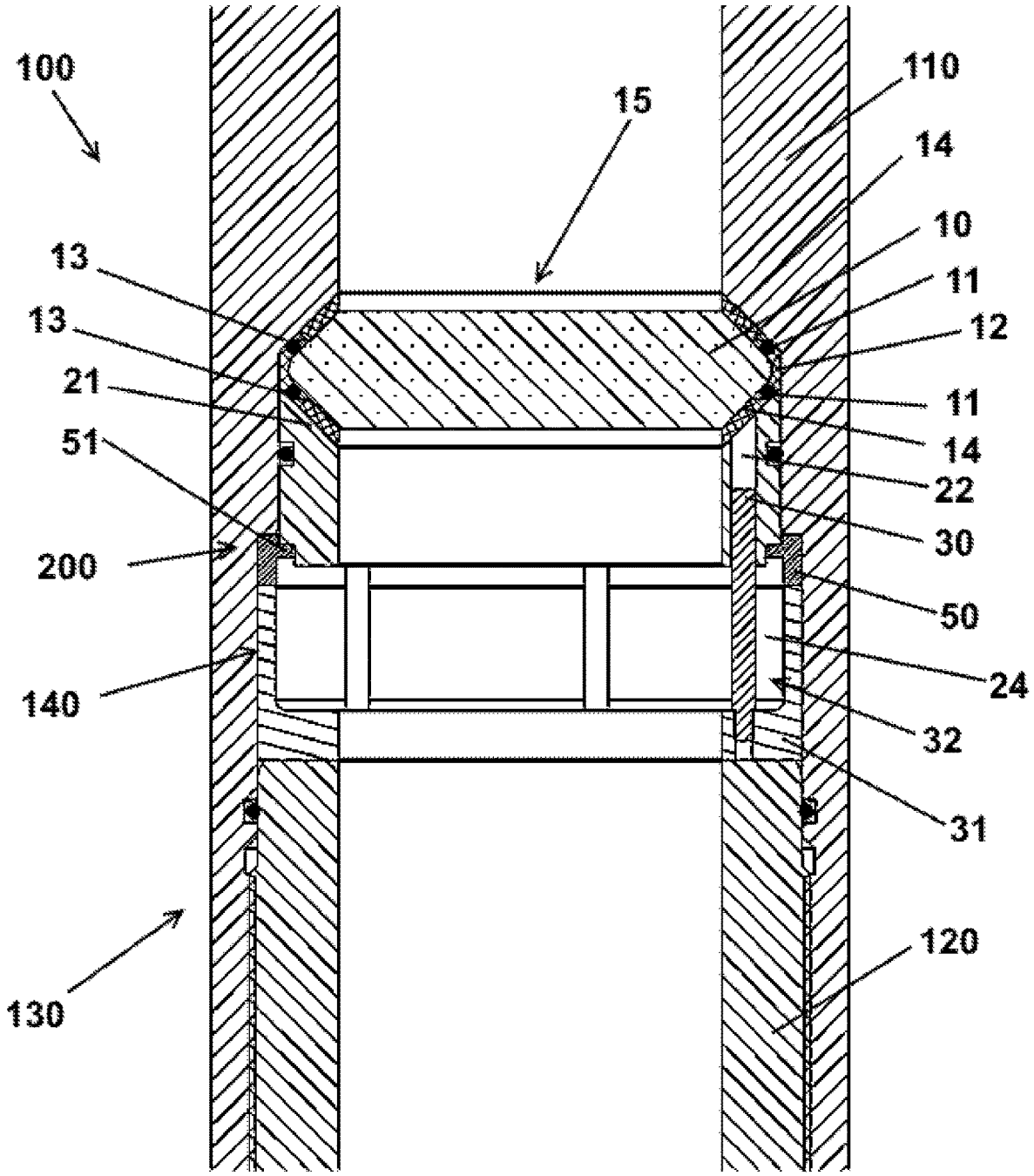
FIG. 1A discloses a side view of a longitudinal cross section of a first example of a plug tubular FIG. 1B discloses a close up of the glass assembly of FIG. 1A FIG. 1C discloses a perspective view of a second example of a plug tubular FIG. 1D discloses a side view of a longitudinal cross section of a third example of a plug tubular

10 Plug 10
11 Sealing Element 11
12 Stabilizer 12
13 Sealing Area 13
14 Bearing Ring 14
15 Glass Assembly 15
60 Plug Surface 60
61 Top Surface 61
62 Bottom Surface 62
63 Top Edge Surface 63
64 Middle Edge Surface 64
65 Bottom Edge Surface 65
66 Edge Surface
20 Seat 20
21 Seat Surface 21
22 Breaker Pocket 22
23 Seat Lip 23
24 Seat Pocket 24
30 Breaker Object 30
31 Breaker Holder 31
32 Breaker Assembly 32
40 Height Adjuster 40
41 Adjustable Seat 41
42 Mechanical Adjuster 42
50 Shear Ring 50
51 Shear Ring Lip 51
100 Plug Tubular 100
110 Upper Tubular 110
120 Lower Tubular 120
130 Tubular Body 130
140 Housing 140
200 Plug Assembly 200

DETAILED DESCRIPTION OF THE INVENTION

Reference will now be made in detail to the present embodiments of the invention, examples of which are illustrated in the accompanying figures. Alternative embodiments will also be presented. The figures are intended to be read in conjunction with both the summary, the detailed description, and any preferred and/or particular embodiments, specifically discussed or otherwise disclosed. This invention may, however, be embodied in many different forms and should not be construed as limited to the embodiments set forth herein. These embodiments are provided by way of illustration only. Several further embodiments, or combinations of the presented embodiments, will be within the scope of one skilled in the art.

As described, there are various ways to open plugs. In the examples given below, the plugs are opened applying pressure, which brings a breaker object 30 into contact with the plug 10, causing it to break. The breaker object 30 does not have to be operated in this manner. Instead applied pressure or a different kind of signal such as that provided by a control line could cause the breaker object 30 to be brought into contact with the plug 10, or it could cause the breaker object 30 to explode, and this explosion could break the plug 10. In some cases the seat 20 will not necessarily move in an axial direction, or move at all. Alternatively, the plug 10 may be designed to be broken by milling it open. The plug 10 could then be arranged in a glass assembly 15, and said glass assembly 15 could be directly secured in the housing 140.

Plugs that can be opened using pressure, operate upon the principle of a plug 10 arranged in a housing 140 of a plug tubular 100. The plug 10 is part of a glass assembly 15 which prevents fluid connection between the upper tubular 110 on the upstream side of the plug and the lower tubular 120 on the downstream side of the plug. A glass assembly 15 comprises the plug 10 and is arranged on a seat 20 for support. Pressure is applied to one side of the plug (normally from the upstream side). At a predetermined absolute pressure, or a predetermined differential pressure, the seat 20 moves in an axial manner until the plug 10 makes contact with a breaker object 30. Upon contact, the plug will disintegrate, and flow through the tubular 100 is restored. The sealing area 13 is the area or areas where it is fluid tight between the plug 10 and the tubular body 130 and/or the plug 10 and the seat 20. Please note that although the examples below refer to a plug 10 opened by applying pressure from above, e.g. a so-called pump open type plug, it is also possible to open the plug 10 with by applying pressure from below, e.g. a so-called surge open type plug. Also note that the plug assembly 200 can be used in a casing, a liner, a tubing, or any other metal pipes used downhole, with any outer and inner diameters.

One important feature for this invention is the curved outermost edge of the plug 10 and details of the sloped or perpendicular sealing area 13.

Figure 1B:
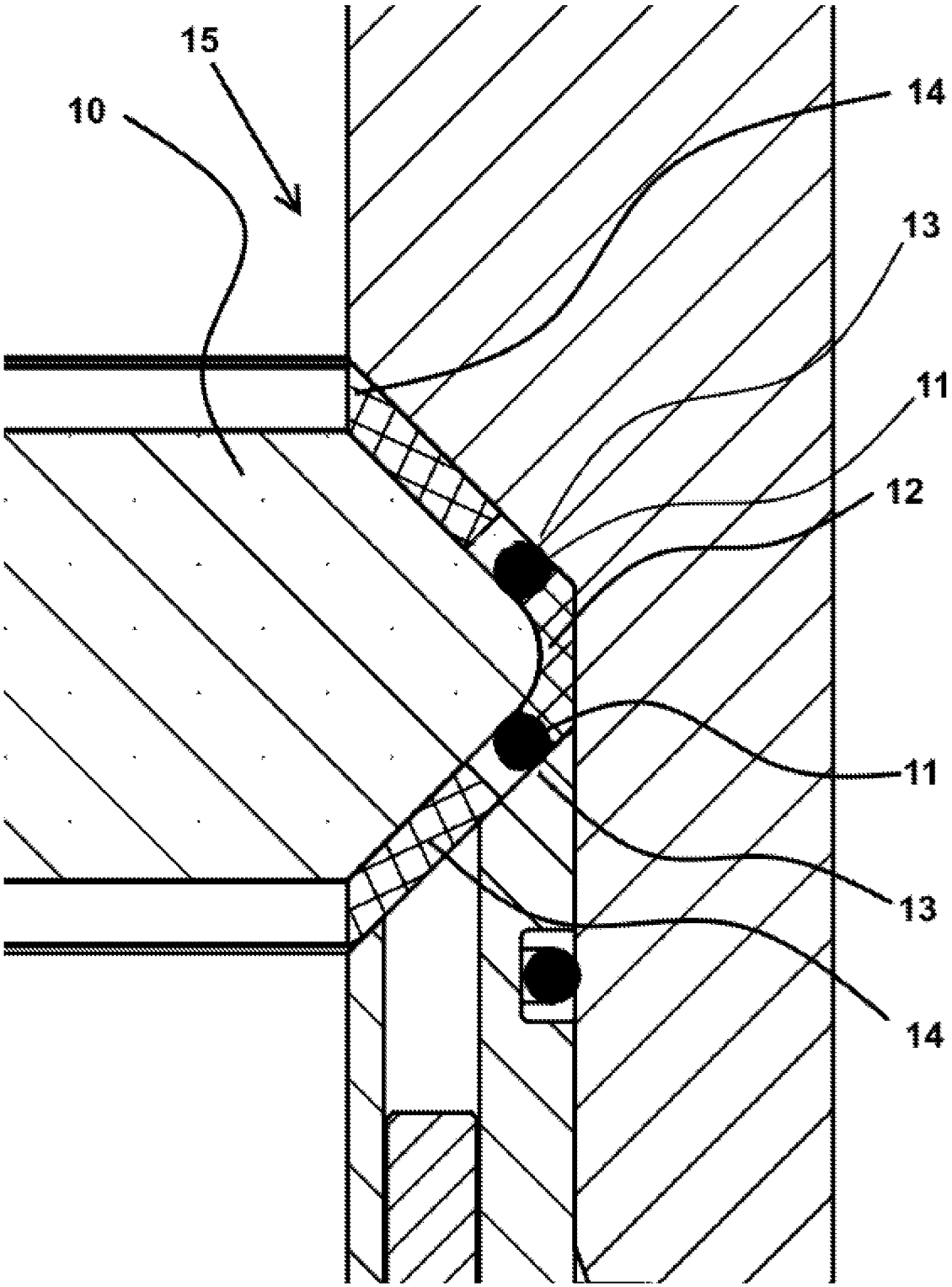
Figure 1C:
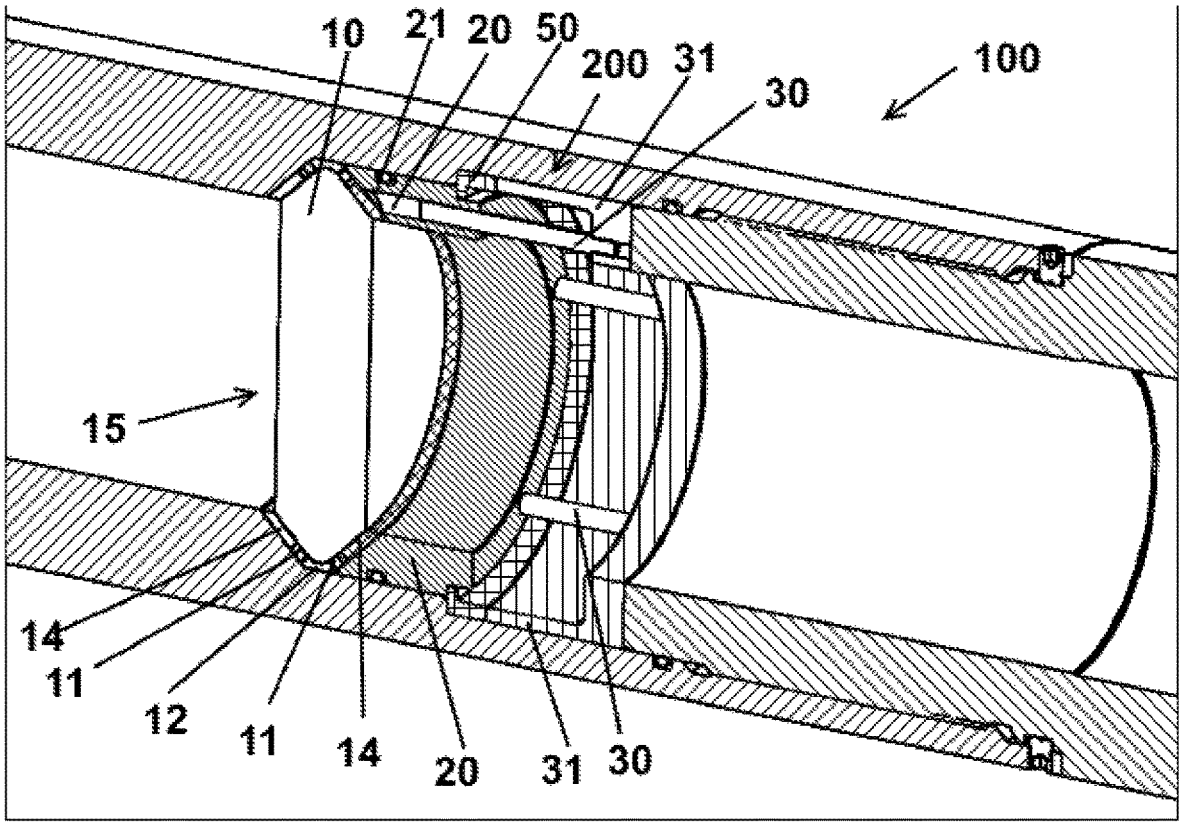

FIGS. 1A-1C disclose examples of a glass assembly 15 with a plug 10 in a plug tubular 100. The plug 10 prevents fluid connection between the fluid inside the upper tubular 110 on the upstream side of the plug and the fluid on the downstream side of the plug inside the lower tubular 120. The glass assembly 15 is arranged on a seat 20. At a predetermined absolute pressure, or differential pressure, the seat 20 moves in an axial manner until the plug 10 contacts a breaker object 30. Upon contact with the breaker object 30 the plug will break and flow through the tubular 100 is restored.

The plug tubular 100 comprises a plug assembly 200 arranged in a housing 140 in a tubular body 130. The tubular body 130 comprises an upper tubular 110 on the upstream side of the plug 10 and a lower tubular 120 on the downstream side of the plug 10. The plug assembly 200 comprises a glass assembly 15, a seat 20, a breaker assembly 32, and a shear ring 50.

The glass assembly 15 comprises a plug 10, a sealing element 11, a stabilizer 12 and a bearing ring 14. The sealing element 11 prevents fluid from traveling around the plug 10. In the example shown, this is found between the plug 10 and the housing 140 on one side and the plug 10 and the seat 20 on the other side. A bearing ring 14 is arranged between the plug 10 and the housing 140 one side and the plug 10 and the seat 20 on the other side. A common example of a sealing element 11 is an O-ring. Note that while glass assembly 15 is called a "glass assembly" it refers to the plug 10 (regardless of material, including non-glass materials).

The sealing area 13 is the area on the housing 140 and seat 20 that is in contact with the sealing element 11. It is this area which accounts for the plug 10 being fluid tight. The sealing element 11 could be arranged on the outside of the plug 10, in a groove in the plug 10, or a groove in the housing 140 and/or seat 20. As will be disclosed below, it is also possible for other elements to be fluid tight as well. Those elements will further contribute to the sealing area 13, but the often the main seal is formed by the sealing element 11. The sealing area 13 does not include the areas in which a fluid tight seal is not provided.

The stabilizer 12 helps to hold the plug 10 in place during operation. Depending upon the exact configuration, it may be possible for the plug 10 to twist in the housing 140 without it. Also, similar to the bearing ring 14 (discussed shortly) it can keep the edge of the plug 10 from making contact with any hard metal surface. The stabilizer 12 shown in all of the figures is curved to match the curved shape of the middle surface of the plug 10. The stabilizer 12 could also be called a middle bearing ring due to its position in between the two "outer" bearing rings 14.

While it is possible for the bearing rings 14 and/or stabilizer 12 to seal somewhat against fluid, and thus be included in the sealing area 13, it is preferable that the stabilizer 12 is not fluid tight. For installation, by cutting slits or separations in the stabilizer 12, it will make it easier (or perhaps even possible depending on the exact geometries) to install. If the stabilizer 12 is such a cut ring, the two ends of the cut can be made to overlap to make the diameter of the stabilizer 12 smaller so that it can be easily inserted. Depending upon the material and/or geometries, this may be necessary. Slits will render the stabilizer 12 non-fluid tight and completely ineffective as a sealing component. Additionally, another reason for not requiring that it be fluid tight is that a wider choice of materials is then available.

The main purpose of the bearing ring 14 is to help reduce the possibility of contact between the plug 10 and hard metal surfaces (e.g. the housing 140 and the seat 20). At higher pressures, a contact between a hard metal surface and the plug 10 could result in a premature breaking. Common materials for bearing rings 14 are soft enough to provide cushioning between the plug 10 and adjacent hard components, such as the seat 20 or housing 140, thus preventing premature breaking of the plug. An example of such materials are soft metals, rubber or plastics, preferably PEEK.

Materials for a stabilizer 12 also include the same soft materials as are used for bearing rings 14, but hard materials such as those used for the other plug assembly components may be used, such as steel or glass.

If needed, the sealing element 11 can be held in place by a stabilizer 12 and/or a bearing ring 14. A stabilizer 12 prevents the sealing element 11 from being pressed toward the outside of the plug 10, and a bearing ring 14 can help hold the sealing element 11 from being pressed toward the inside of the plug when under operation.

A breaker assembly 32 is an element that contains and supports the breaker object 30. A breaker object 30 is arranged to break the plug 10 when they make contact. In the example shown, the breaker object 30 is held in a breaker holder 31. It is also possible for the breaker object 30 to be directly affixed to the housing 140.

The glass assembly 15 is supported by the seat 20. The plug 10 will be directly or indirectly supported by the topmost portion of the seat 20, the seat surface 21. When the seat 20 moves in an axial direction, the plug 10 will move with it. In the example shown, the seat 20 has a breaker pocket 22 that is arranged such that the breaker object 30 pass through the seat 20. The seat 20 has a seat lip 23. This is a protrusion that extends past the shear ring lip 51 of the shear ring 50. Because the seat 20 extends at least a portion past the edge of the shear ring lip 51, the shear ring lip 51 is held in place when plug assembly 200 has completed its operation.

Beneath the seat 20 is the seat pocket 24. The seat pocket 24 is a space that can receive the seat 20 when it moves in an axial direction under operation.

A shear ring 50 is arranged such that it supports the seat 20 on its shear ring lip 51. When the proper threshold pressure (absolute or differential) is reached, the shear ring will break into two different pieces. One portion will remain stationary, and the shear ring lip 51 will travel axially. Note that instead of a shear ring, shear pins, or other such elements could be used. Note that the shear ring 50 can have different shapes. That of FIGS. 1A and 1B have the shear ring lip 51 a distance from the edge of the shear ring 50 (this is sometimes referred to as a "T" shape), while that of FIG. 1C has the shear ring lip 51 on the edge of the shear ring 50 (sometimes referred to as an "L" shape). The purpose of the shear ring 50 is to shear into two pieces, the exact arrangement can be as required for a given application. By changing the thickness of the shear ring lip 51, or making it discontinuous around the edge of the shear ring 50, it can be easily adjusted to shear at different applied pressures. The shear ring lip 51 can then preferably be changed in thickness in the downward direction in the figures, as this protrudes into the hollow space of the receiving pocket 24 and no other components will have to be changed. It is also possible to make the shear ring 50 from different materials with different mechanical properties, and hence change the shear value.

Depending upon operating conditions and material composition concerns, it may be possible for the glass assembly 15 to include a plug 10 and a single sealing element 11, or a plug 10 and a stabilizer 12.

Figure 1D:
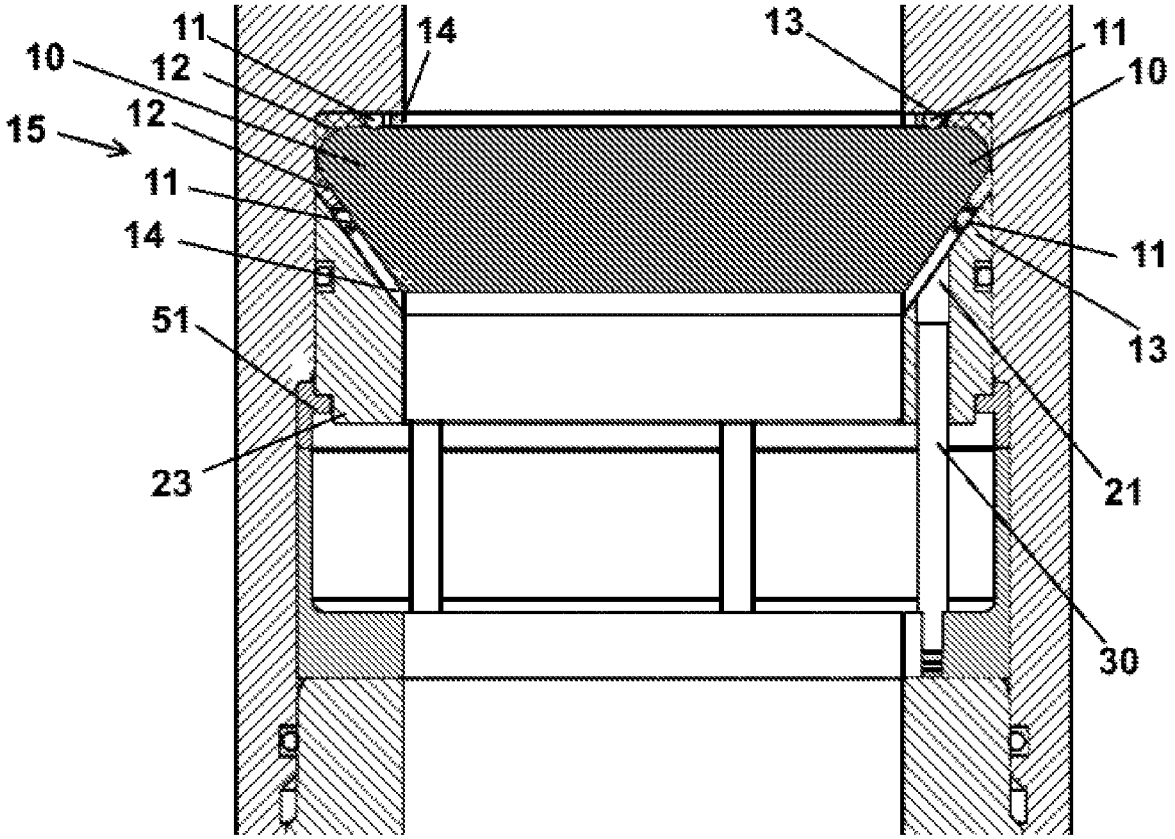

FIG. 1D discloses another example of a glass assembly 15 with rounded edges. The plug 10 in this example is different from the previous one. Rather than the rounded portion being in between two chamfered angled portions, the rounded portion is between a flat horizontal portion on the figure and an angled bottom portion. The glass assembly 15 comprises a plug 10, a sealing element 11 between the plug 10 and housing 140 and another sealing element 11 between the plug 10 and seat surface 21, a bearing ring 14 between the plug 10 and the housing 140 and a bearing ring 14 between the plug 10 and the seat surface 21, and a stabilizer 12 between the plug 10 and the housing 140 and/or seat surface 21.

It is possible that the stabilizer 12 is made up of more than one separate piece. For example, this could be due to the physical dimensions of the system or the shape of the plug 10 or housing 140 or seat 20. It could also make installation simpler. As shown in the previous figures, the bearing ring 14 and the stabilizer 12 help to hold each of the sealing elements 11 in place.

Also shown is the arrangement where the seat lip 23 is held in place by the shear ring lip 51 to prevent the shear ring lip 51 from entering the wellbore.

The preferred angle of the chamfers is between 1 and 45 degrees, preferably 25 to 45 degrees, measured from the centerline. 90 degrees (perpendicular to the centerline) is also a good alternative. The radius of curvature of the rounded outer edge is preferably between 1 mm and 10 mm. The angle on the overside and underside of the plug does not need to be the same.

While the tubular body 130 in the figures is shown as comprising an upper tubular 110 and a lower tubular 120, it could also be made of a single continuous piece.

In FIG. 1D, the rounded portion of the plug is between the top surface and the edge surface, as opposed to that of the middle. This is where the widest part of the plug 10 meets a surface with a different angle. Further details of the surface geometry will be discussed in FIGS. 5A-5E.

Figure 2A:
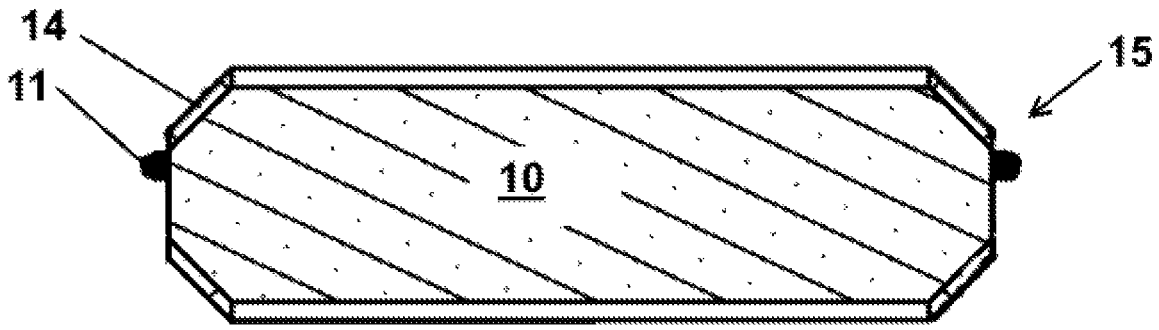
FIG. 2A shows a side cross-section of an example of a glass assembly without curved surfaces
Figure 2B:
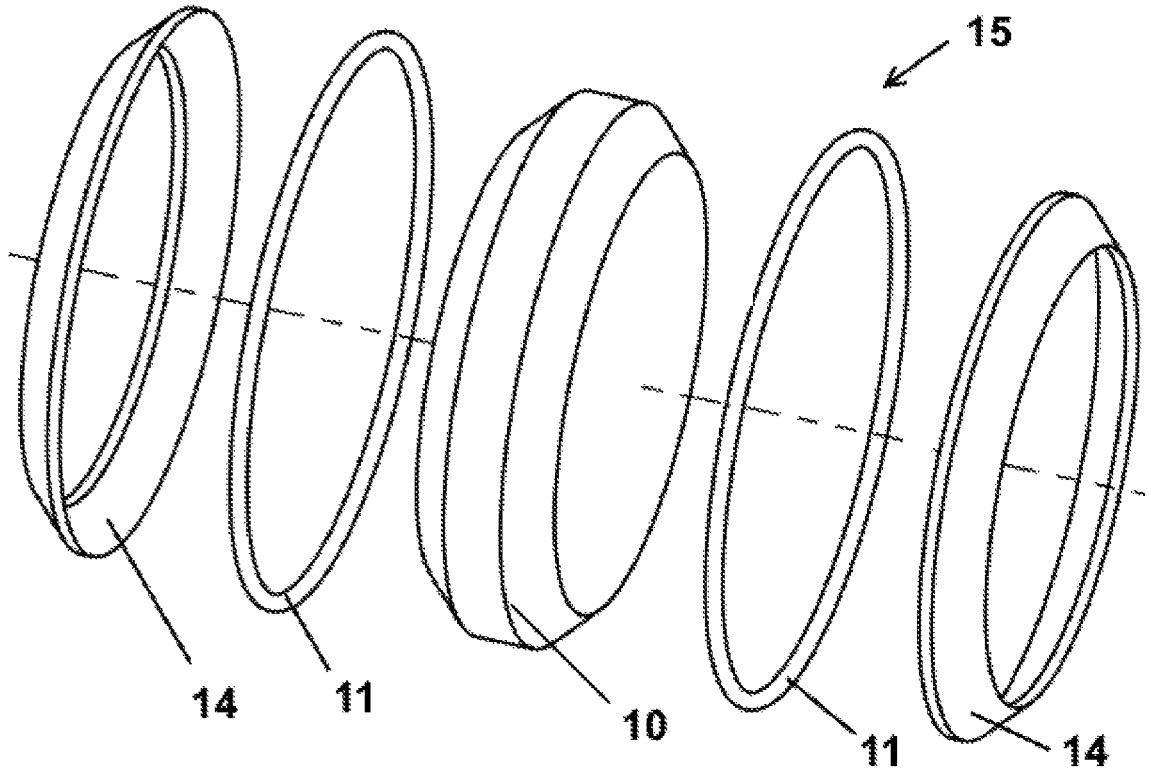
FIG. 2B shows an exploded view of an example of a glass assembly without curved surfaces FIG. 2C discloses a perspective cross-section of an example of a glass assembly FIG. 2D discloses an exploded view of the example of FIG. 2C FIG. 2E discloses a perspective cross-section of an example of a glass assembly with multiple plugs FIG. 3A discloses a side view of a longitudinal cross-section of the operation of a plug tubular in the first position FIG. 3B discloses a side view of a longitudinal cross-section of the operation of a plug tubular in the transition between the first and second positions FIG. 3C discloses a side view of a longitudinal cross-section of the operation of a plug tubular in the second position FIG. 3D discloses a side view of a longitudinal cross-section of the operation of a plug tubular in the third position FIG. 4 discloses a side view of a longitudinal cross section of an example of a glass assembly with a height adjuster

FIGS. 2A and 2B shows glass assemblies without curved surfaces. The top and bottom edge surface of the plug 10 is chamfered. On these chamfers is arranged a bearing ring 14. The sealing element 11 is arranged at the middle portion of the plug 10, which is straight. There is no stabilizer 12 or rounded middle edge surface as given in FIGS. 2C and 2D. In FIG. 2D, the stabilizer 12 is shown with a split in order to facilitate easier installation.

Figure 2C:
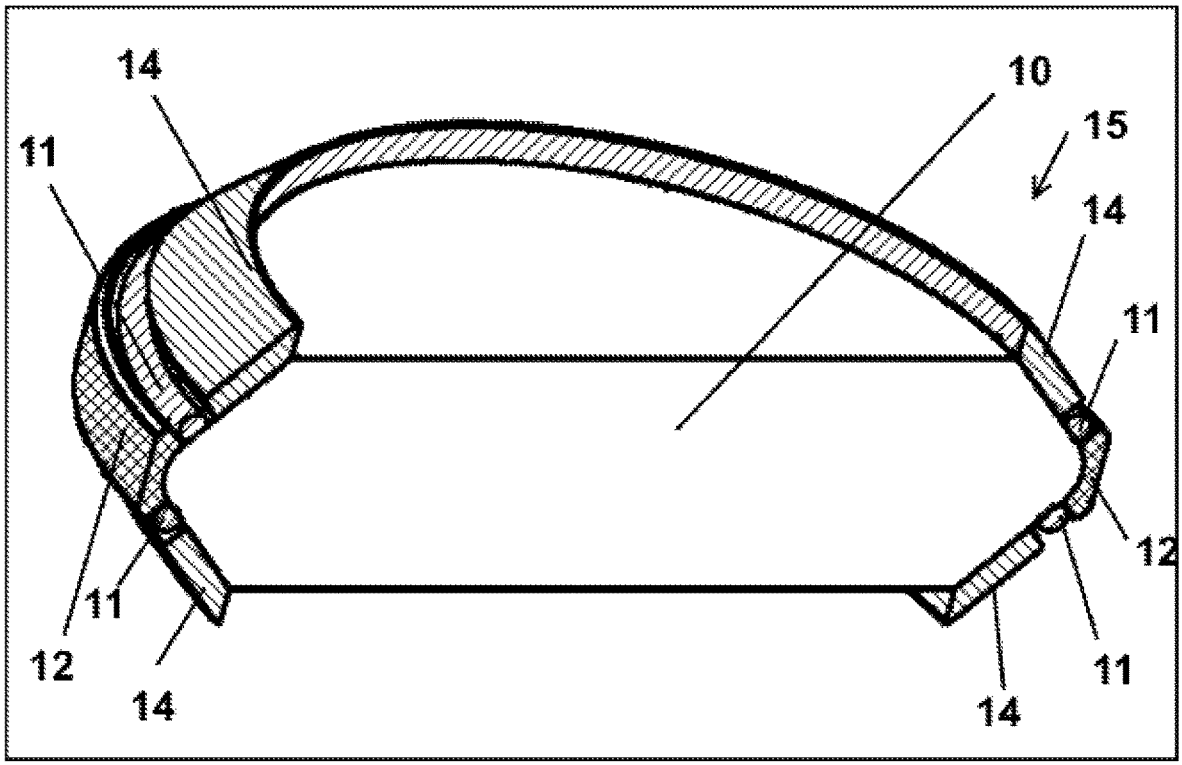
Figure 2D:
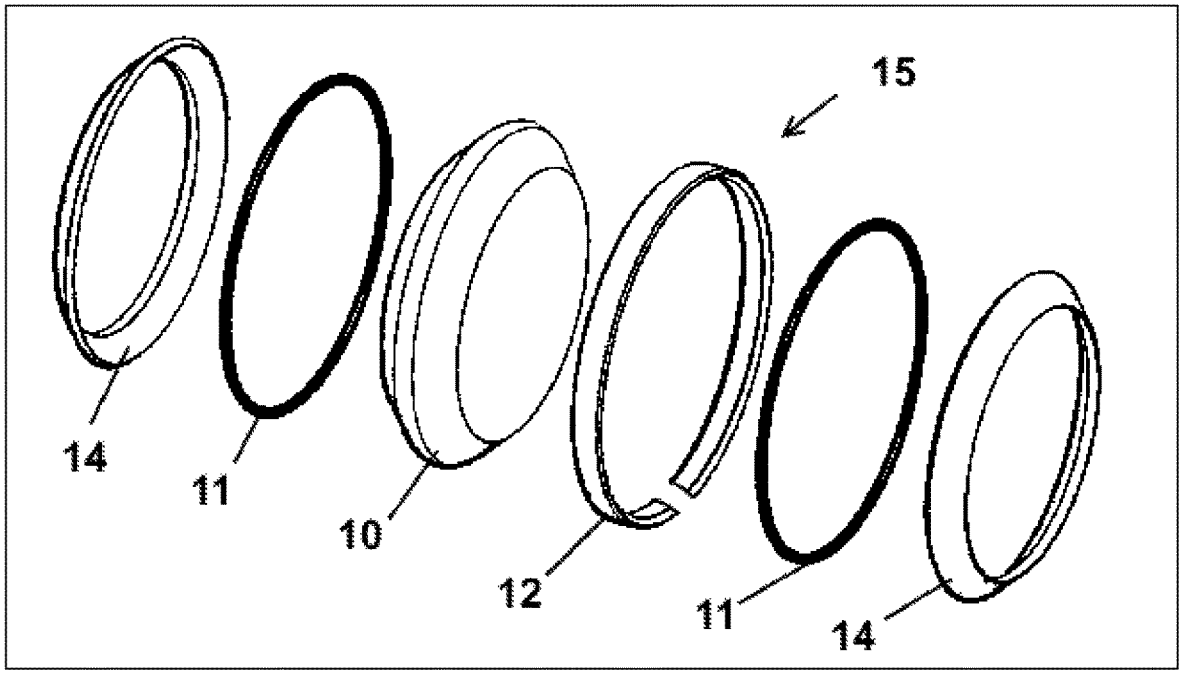

FIGS. 2C and 2D disclose an example of a glass assembly 15 with a curved edge surface. The plug 10 has a chamfer/bevel on the top and bottom edge surfaces with a rounded portion connecting them. On these top and bottom edges is arranged a bearing ring 14. As stabilizer 12 is arranged in contact with the rounded portion of the plug 10. Sealing elements 11 are arranged between each bearing ring 14 and stabilizer 12.

The plugs 10 shown in FIG. 2A and FIG. 2B plug 10 has some combination of vertical, chamfered, or beveled edges. In particular, the widest portion of the plug 10 has a vertical edge. However, where two straight edges meet (e.g. a corner or a chamfer), that point is vulnerable to stress. Especially the area between the widest part of the plug and the first surface with a different planar angle has a higher chance of breaking. Please note that the plugs 10 of the examples of FIGS. 2A and 2B are the same, but the glass assemblies 15 differ in that while there is only one sealing element 11 in FIG. 2A, there are two sealing elements 11 shown in FIG. 2B. If the righthand sealing element 11 of FIG. 2B were removed, this figure would depict an exploded view of FIG. 2A.

Under higher pressures, these areas can become susceptible to premature breakage. However, the plug 10 in FIG. 2C and FIG. 2D as shown has a chamfered edge on the top and bottom and a rounded edge between them. This gives the outermost edge of the plug 10 a curved profile. This curved profile allows the plug 10 to be more robust against unwanted breakage than a sharp corner would be.

Figure 2E:
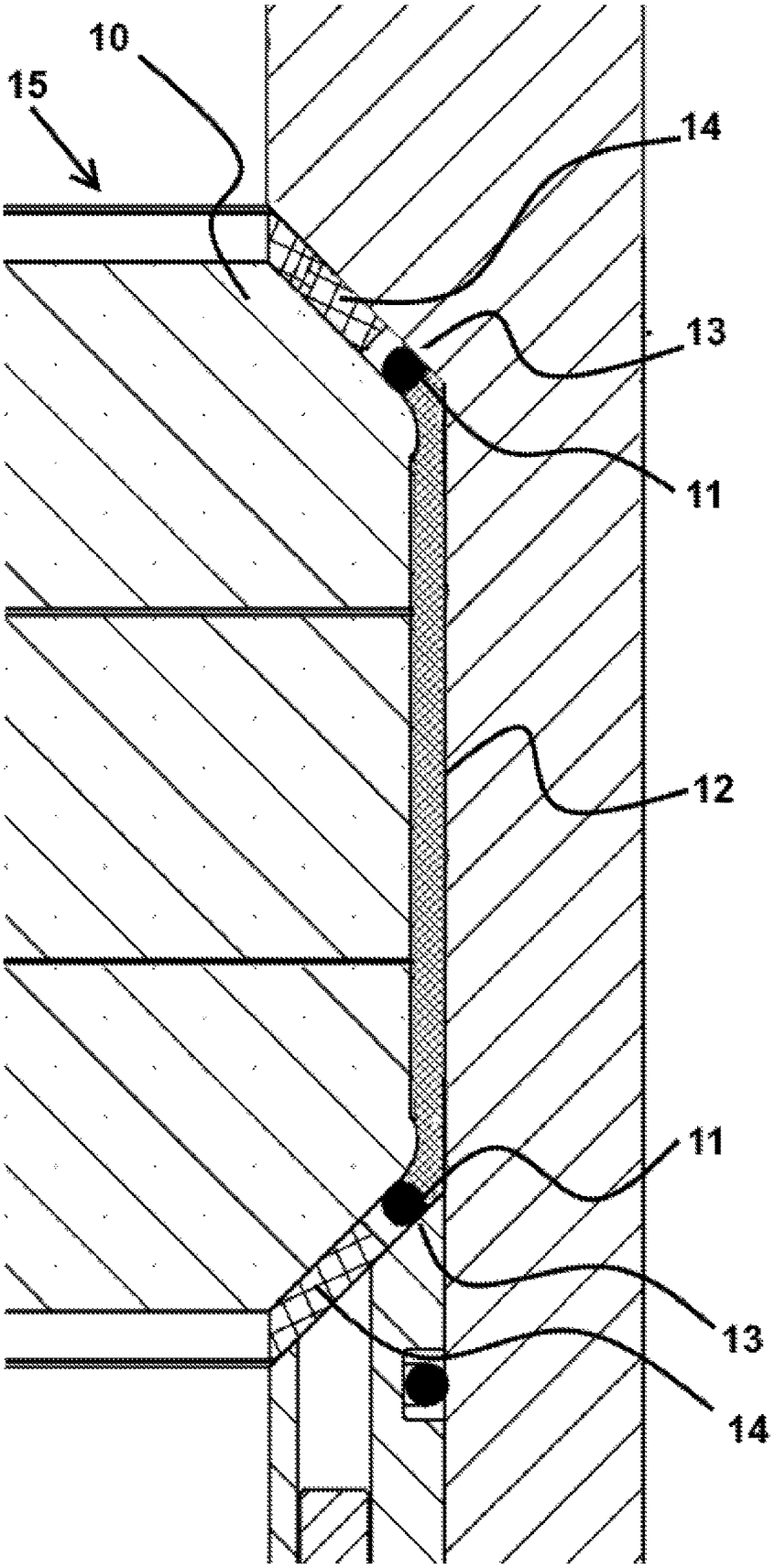

FIG. 2E discloses an example of a glass assembly 15 made of multiple layers. This can either be multiple layers of material in the same plug 10 (as shown in the example) or multiple discrete plugs 10 in the glass assembly 15. The example shown has a bearing ring 14 at the top and bottom portion of the plug 10, and a stabilizer 12 which covers the middle edge of the plug 10. A sealing element 11 is arranged between the bearing ring 14 and the stabilizer 12 on both sides of the plug 10. While the stabilizer 12 in this example is larger than that of the other figures, it is simply large to accommodate the thicker plug 10. It would also be possible for the stabilizer 12 to be in multiple pieces. In the case of multiple plugs 10 in the glass assembly 15, each individual plug 10 could have its own stabilizer 12 and/or sealing element 11.

The degree of fluid tightness is largely determined by the number and placement of sealing elements 11. For example, there could be the same number of stabilizers 12 as plugs 10, to avoid twisting, and two sealing elements 11 for each plug 10. For another example, if there are multiple plugs, rather than have one or two sealing elements 11 and one stabilizer 12 per plug, it is possible that there is only a sealing element 11 in contact with the uppermost plug 10 (as refenced to uphole) and another sealing element 11 in contact with the downhole most plug 10. The bearing ring could be in contact with the edges of all of the plugs 10, or only in contact with less than all of the plugs 10. This can be accomplished using a single stabilizer 12 or several stabilizers 12.

The sealing area 13 in the case of multiple plugs 10 or multiple layers of material in the plug 10, is determined in the same way as for a single plug of a single layer (i.e. the regions of the plug 10 that are fluid tight as determined by the sealing element 11 and other possible contributors).

Figure 3A:
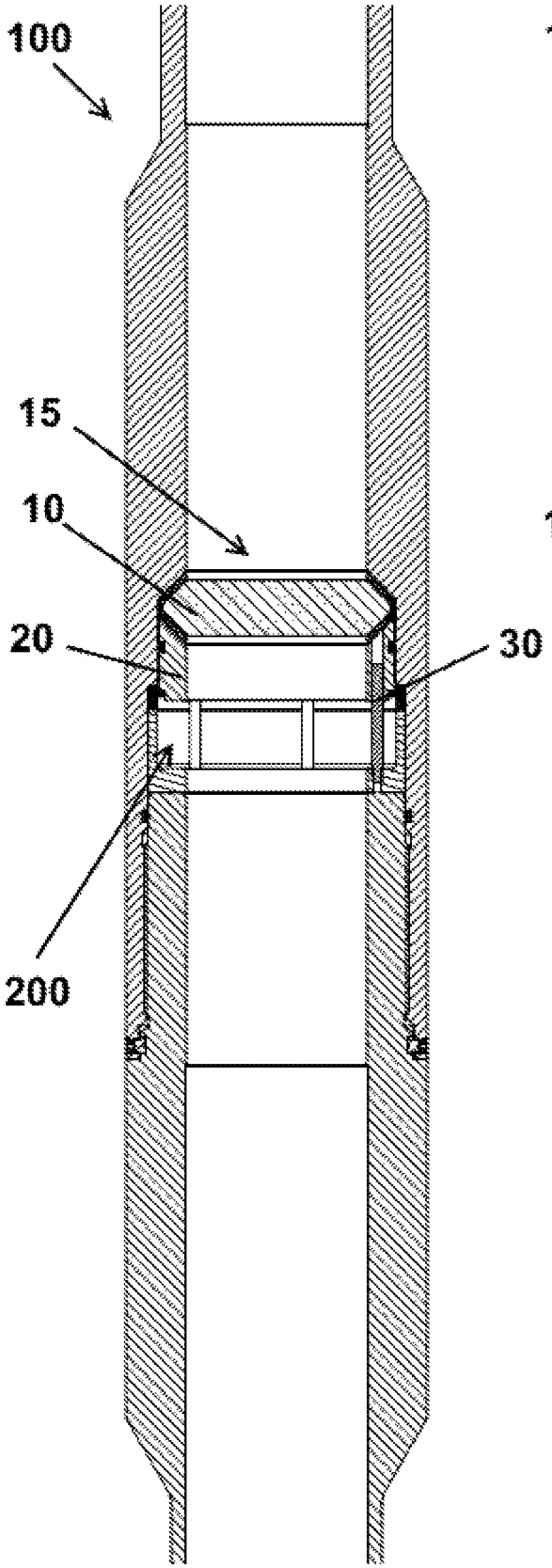
Figure 3B:
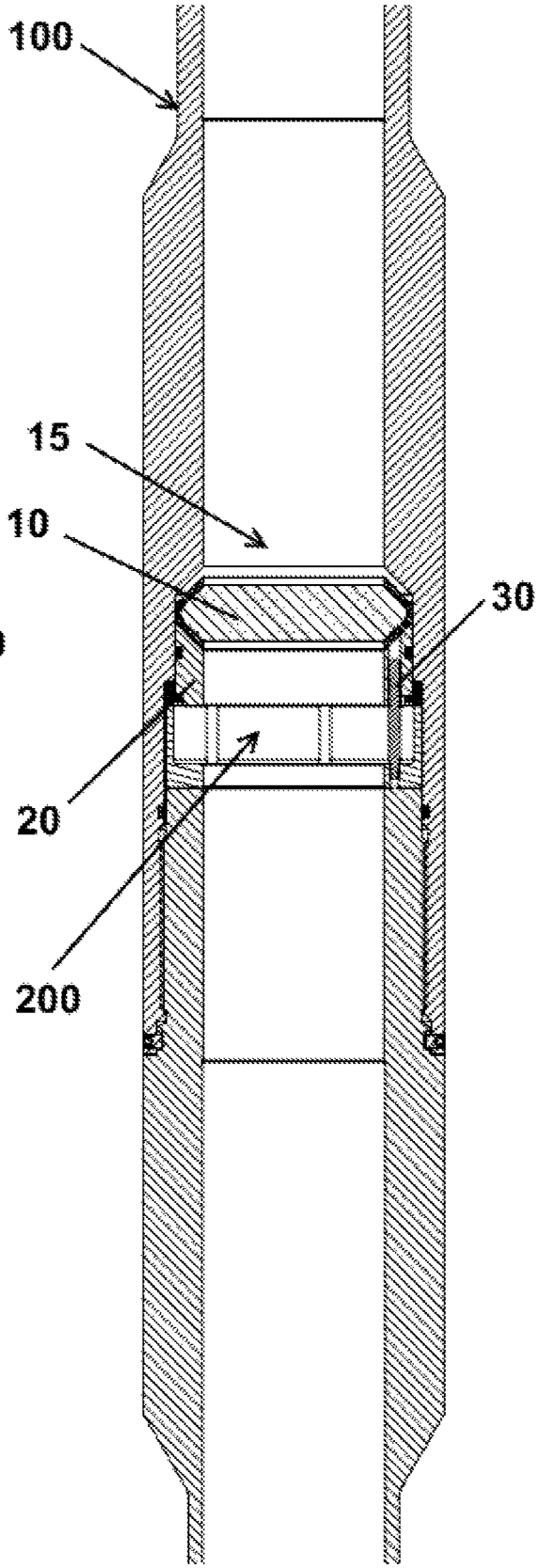
Figure 3C:
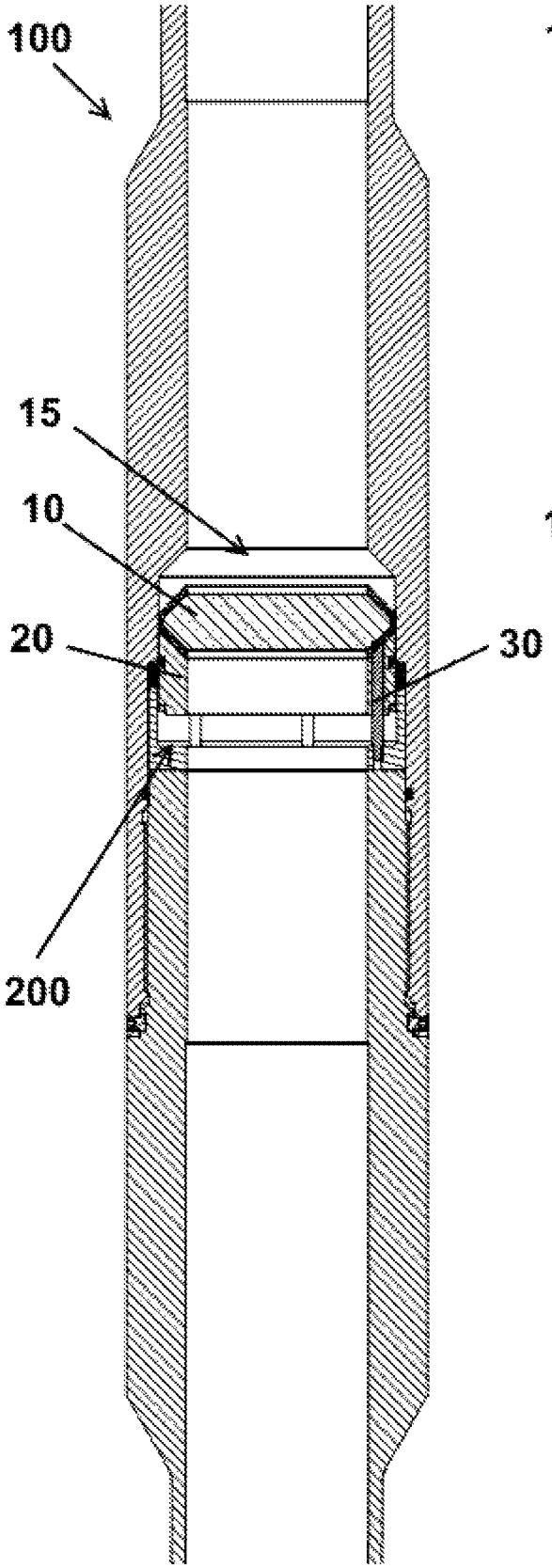
Figure 3D:
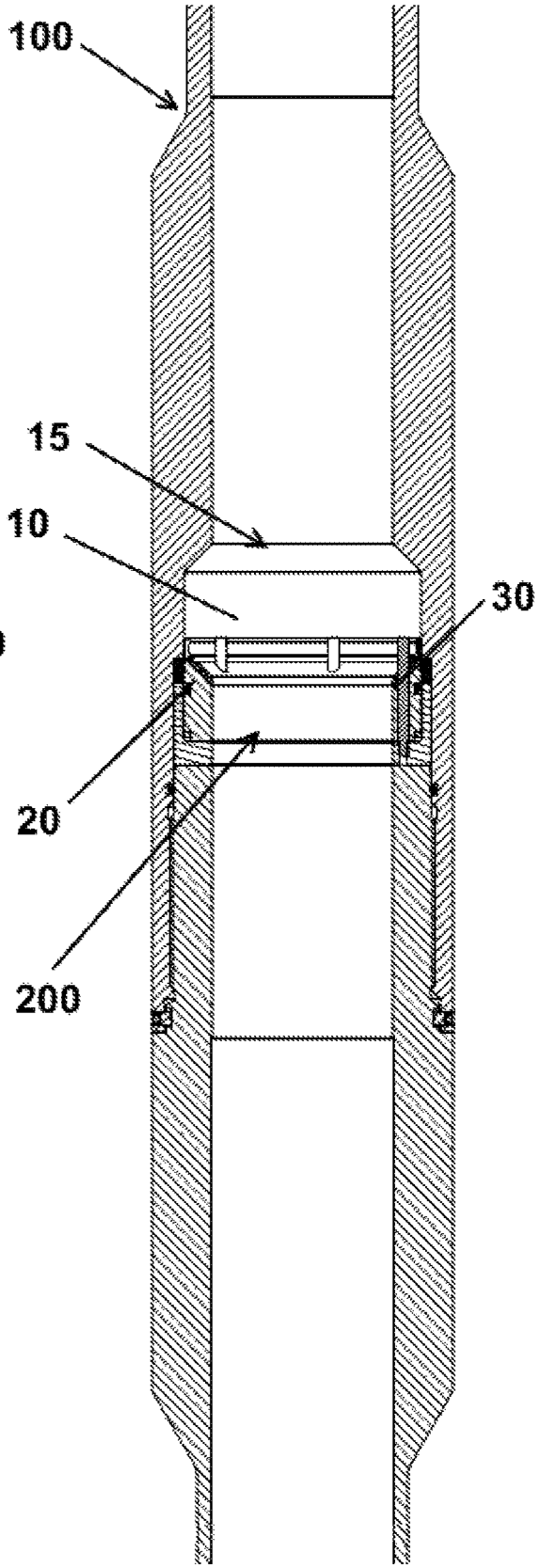

FIGS. 3A-3D disclose the operation of a plug tubular 100 in the first, second, and third positions. FIG. 3A disclose the first, starting position. In FIG. 3A the plug 10 is not moving. FIG. 3*b* disclose a position in-between the first position and the second position, where the shear ring 50 has sheared and the seat 20 and the plug 10 are moving toward the breaker object 30. FIG. 3C disclose the second position, where the plug 10 makes contact with the breaker object 30. FIG. 3D disclose the third position, where the plug 10 has disintegrated and movement has ceased.

Thus, a plug assembly 200 has at least three different positions, depending upon the status of the plug's integrity and its position. In the first position, the seat 20 is stationary with respect to the tubular body 130 and the plug is intact. After the pressure threshold requirements are met, the plug assembly 200 transitions from the first position to the second position. In the second position, the seat 20 has moved axially until the plug 10 is in contact with the breaker object 30. The third position is when the plug 10 is destroyed and fluid connection is reestablished through the tubular 100. Note that the tubular 100 is in the same position as the plug assembly 200 that it houses. The plug 10 is arranged in the glass assembly 15. The sealing area 13 (not shown) would be where each sealing element 11 makes contact with the housing 140 (not shown) and/or the seat 20 (not shown).

Figure 4:
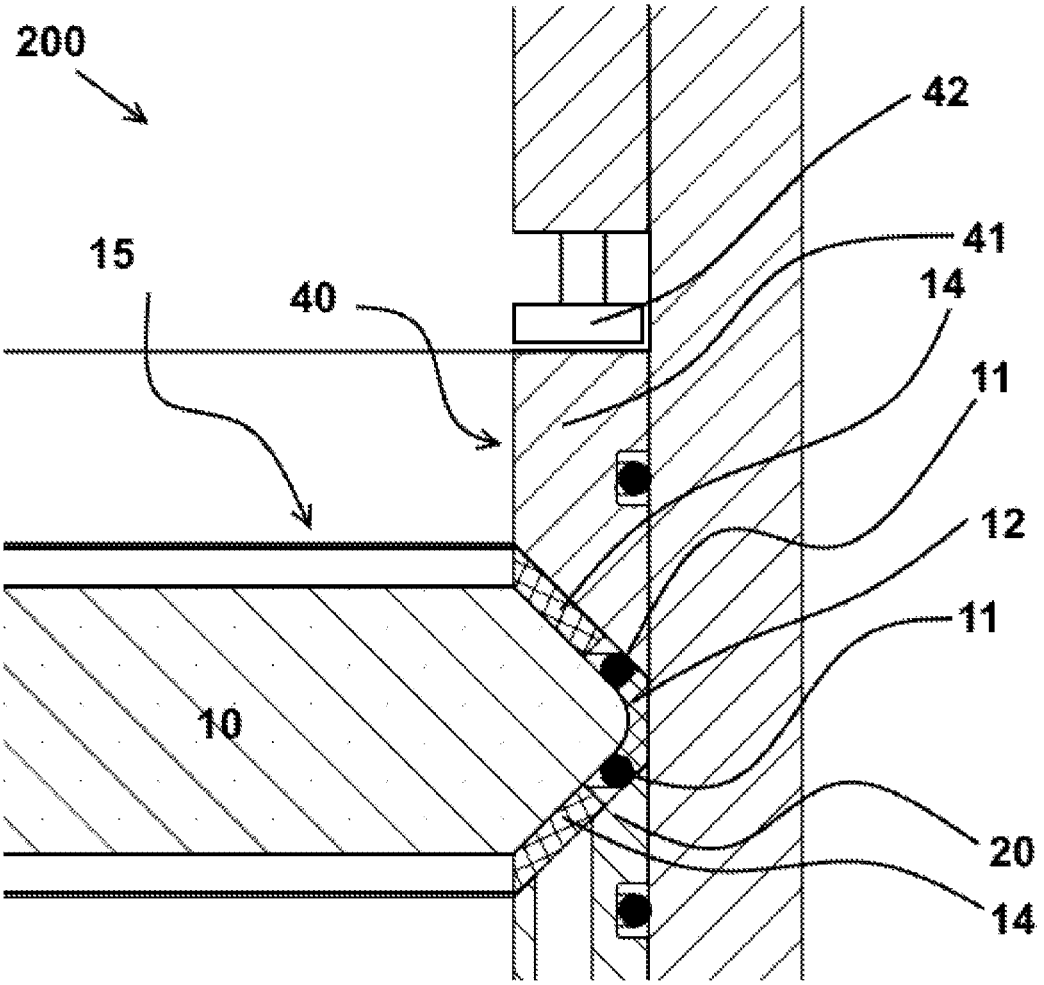

FIG. 4 discloses a plug assembly 200 which comprises a height adjuster 40 on one side of the plug 10 and a seat 20 on the other side of the plug 10. The purpose of the height adjuster 40 is to allow for the height of the housing 140 on one side of the plug 10 to be adjusted. In this way, the space can be made larger for installation of the glass assembly 15, the glass assembly 15 inserted into the plug assembly 200, and the space made smaller with the height adjuster 40 to hold the glass assembly 15 in place. This will allow for the plug to be held in place better and/or easier installation of the glass assembly 15. This in turn allows for wider tolerances of the glass assembly 15, i.e the parts said assembly is made up of can have a wider range of tolerances when manufactured, because small differences can be made up for by adjusting the height adjuster 40.

In the disclosed example, the height adjuster 40 comprises an adjustment seat 41 and a mechanical adjuster 42. By adjusting the mechanical adjuster 42 (e.g. a nut or spring), the distance of the height adjuster 40 from the plug 10 is changed. In this example, the adjustment of the mechanical adjuster 42 moves the adjustment seat 41.

An example of a glass assembly 15 is disclosed comprising a plug 10 (the example shown is the same as in FIGS. 1A, 1B, 2C, 2D, 3A-3D). It comprises a bearing ring 14 between the height adjuster 40 and the plug 10 and a second bearing ring 14 between the seat 20 and the plug. A stabilizer 12 is arranged between the outermost edge of the plug 10 and the housing 140. Sealing element 11 are arranged between each bearing ring 14 and the stabilizer 12. As in the previous examples shown, the sealing element 11 is in contact with angled surfaces. In this example the seat surface 21 is angled, and the height adjuster 40 in contact with the sealing element 11 is angled. In the example shown, a mechanical adjuster 42 is arranged over the adjustable seat.

In an example, the height adjuster 40 can have threads on the outside which match threads in the housing 140 or tubular body 130. By turning the height adjuster 40, the gap between the adjustment seat 41 and the plug 10 would be adjusted. The threads do not need to run along the entire body of the height adjuster 40. They can for example run only on the upper portion (towards uphole) of the height adjustor, while the lower portion (towards the plug) has no threads against the housing but rather a seal against the housing. In this way the height adjuster 40 is a single piece, there is no separate mechanical adjuster 42. This is a preferred example of the height adjuster 40, as only one component is needed.

Thus, the height adjuster 40 is not limited to the example shown in FIG. 4 with the sloped edges and a rounded edge. In another example thereof, if the plug 10 has a square outer edge and does not have bearing ring 14, then the height adjuster 40 will normally have a flat surface where the adjustment seat 41 makes contact with the plug 10. If there is a bearing ring 14, then the adjustment seat 41 will have a contact surface that keeps the bearing ring 14 in place on the plug 10. The mechanical adjuster 42 can be also be a ring with threads along the outside that match treads in the housing 140. As the ring is turned, it pressed down on the adjustment seat 41.

FIGS. 5A-5D disclose different examples of a plug 10 where the plug surface 60 is made of straight surfaces (lines in the case of the 2D cross sections). The plug surface 60 comprises a top surface 61, and an edge surface 66. The edge surface comprises a bottom surface, a top edge surface 63, a middle edge surface 64, and a bottom edge surface 65.

Figure 5A:
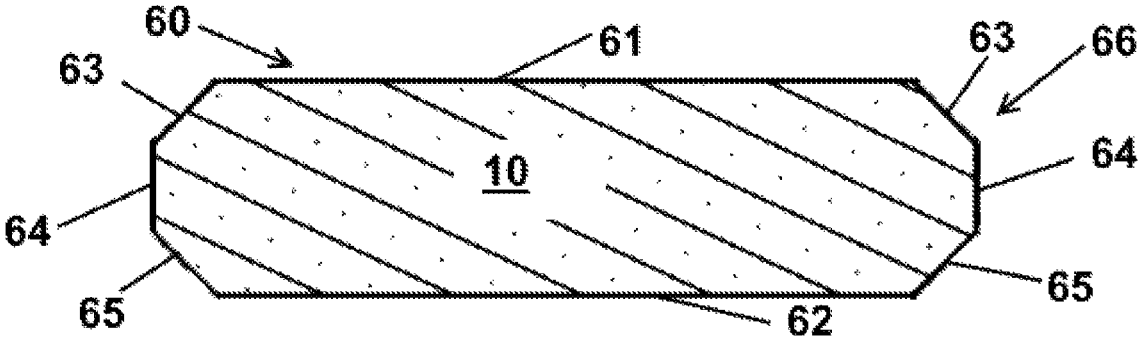
FIGS. 5A-5C shows a cross-sectional side view of examples of plug surface geometries without curved surfaces FIGS. 5D and 5E disclose a cross-sectional side view of examples of plug surface geometries with curved surfaces
Figure 5B:
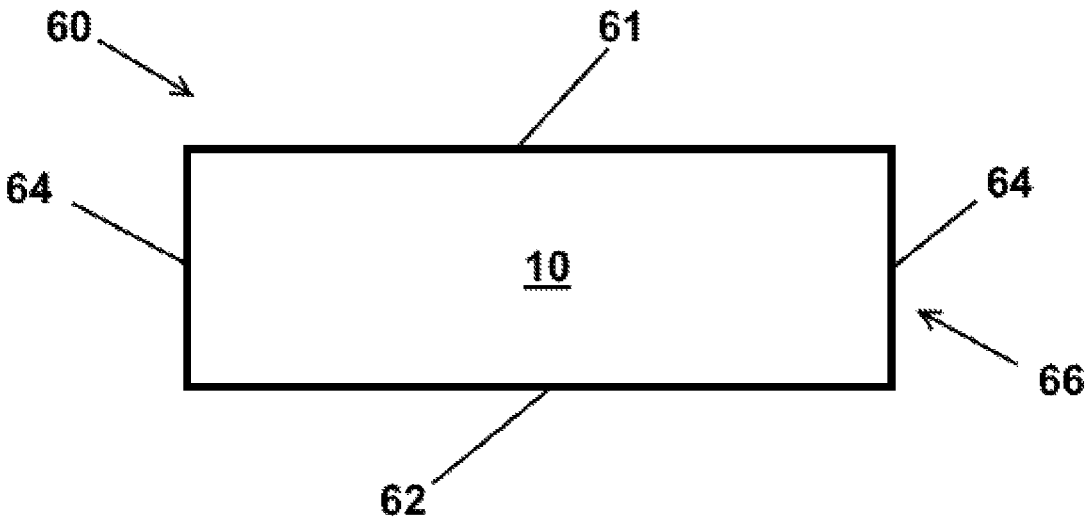

The top edge surface 63 and bottom edge surface 65 are in reference to the middle edge surface 64. The middle edge surface 64 will be the edge surface 66 that contains the widest portion of the plug 10. In FIG. 5A, the plug 10 the edge surface 66 only has a middle edge surface 64 and two other surfaces (top edge surface 63 and bottom edge surface 65). The example plug 10 shown in FIG. 5B is rectangular and thus the edge surface 66 is the middle edge surface 64 (i.e. no top edge surface 63 or bottom edge surface 65). The example plug 10 shown in FIG. 5C has a plug surface plug surface 60 with a middle edge surface 64 and a bottom edge surface 65 (i.e. no top edge surface 63).

Figure 5C:
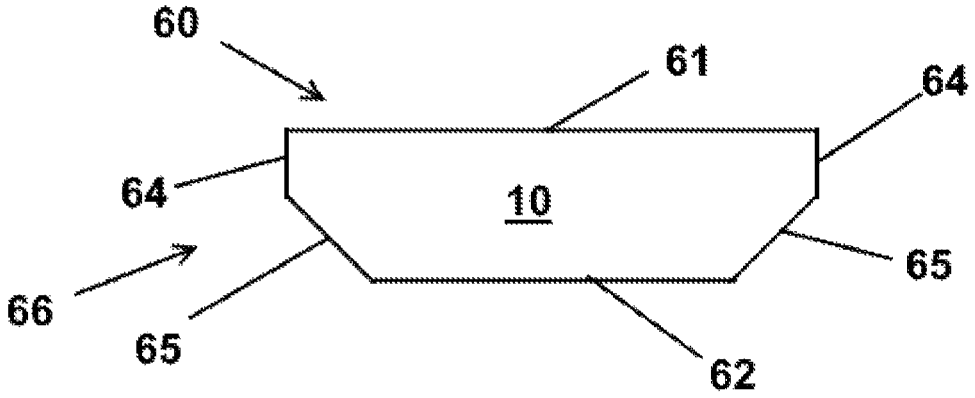
Figure 5D:
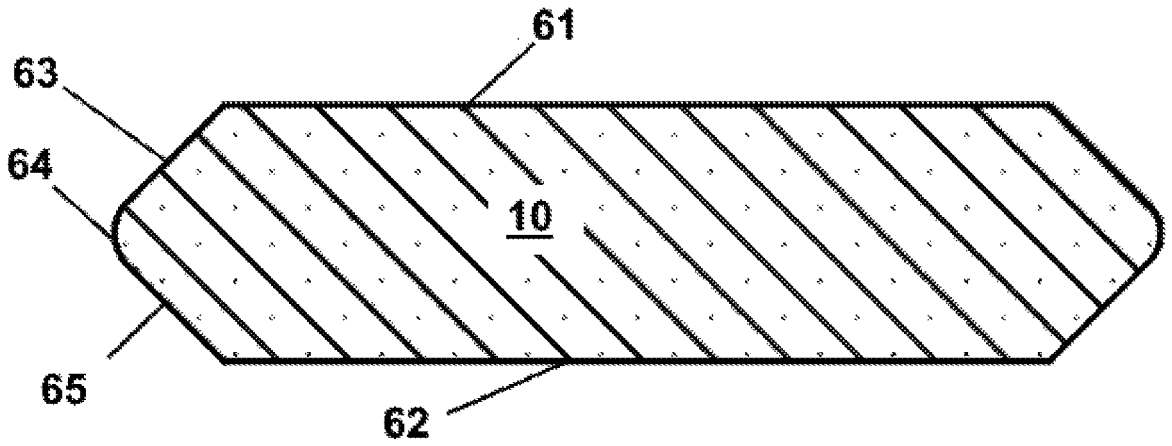
Figure 5E:
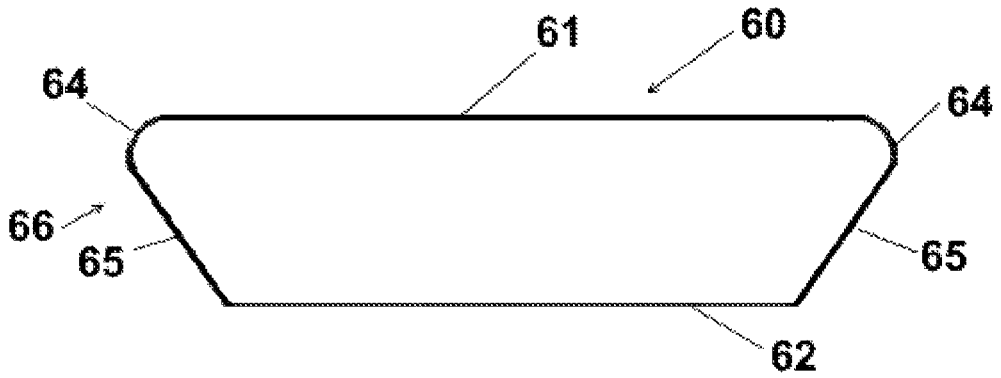

However, in examples of the plug 10 in FIG. 5D-5E the middle edge surface 64 is curved. In the case of FIG. 5D, the middle edge surface 64 is arranged between a top edge surface 63 and a bottom edge surface 65. In the example of FIG. 5E, the edge surface 66 does not comprise a top edge surface 63 but does comprise a bottom edge surface 65 and a middle edge surface 64.

In the examples of FIG. 5B, FIG. 5C, and FIG. 5E, there is no top edge surface 63, in this case the top edge surface 63 is the top surface 61. In the event of a plug 10 with a middle edge surface 64 that has a top edge surface 63 but not a bottom edge surface 65, the bottom surface 62 could be considered the bottom edge surface 65.

While the examples of FIGS. 5A, 5B and 5D are symmetrical between top and bottom of the plugs 10, where "top" and "bottom" refers to the figures, the examples of FIGS. 5C and 5E are not. Please note that although the examples of FIGS. 5C and 5E are drawn in this direction, the direction of such plugs 10 in the well could be upside down from what is shown in said figures. This would depend on the intended application of the glass or plug assembly. If for instance the plug 10 of FIG. 5D is to be used in a plug assembly intended to be opened by a pressure surge from below the plug assembly, it may be preferable to turn it upside down as compared to the orientation shown in the figure.

Please note that "step of" is not to be interpreted as "step for". By "comprised of", "comprising", "comprises" etc. we are referring to an open set and by "consisting of" we are referring to a closed set.

Modifications to the embodiments previously described are possible without departing from the scope of the invention as defined by the accompanying claims. Numerals included within parentheses in the accompanying claims are intended to assist understanding of the claims and should not be construed in any way to limit the subject matter claimed. Reference to the singular is also to be construed as relating to the plural unless expressly stated otherwise. Any reference numbers in the claims are provided as a courtesy and are not to be interpreted as limiting the claim in any way.

It is hereby claimed:

1. A frangible assembly (15) comprising:

a plug (10) with a plug surface (60) which comprises: an edge surface (66), the edge surface (66) comprising a top edge surface (63), a middle edge surface (64), and a bottom edge surface (65);

wherein the plug is made of metal, stone, composites, ceramics, or glass;

wherein the middle edge surface (64) contains a widest portion of the plug (10); and wherein a stabilizer (12) is arranged in direct contact with the middle edge surface (64); and wherein the stabilizer (12) itself allows fluid to flow through it.

2. The frangible assembly (15) according to claim 1, further comprising a bearing ring (14) and a sealing element (11), both in contact with the plug surface (60), wherein the sealing element (11) is arranged between the bearing ring (14) and the stabilizer (12).

3. The frangible assembly (15) according to claim 1, further comprising a first bearing ring (14), a second bearing ring (14), a first sealing element (11), and a second sealing element (11), all in contact with the plug surface (60), wherein:

the first sealing element (11) is arranged between the first bearing ring (14) and the stabilizer (12); and the second sealing element (11) is arranged between the second bearing ring (14) and the stabilizer (12).

4. The frangible assembly (15) according to claim 1, wherein the stabilizer (12) itself comprises a non-liquid and a non-elastomeric material.

5. The frangible assembly (15) according to claim 2, further comprising a sealing element (11), wherein the stabilizer (12) is not a portion of the sealing element (11).

6. A plug assembly (200) comprising:

a frangible assembly (15), arranged in a housing (140);

the frangible assembly (15) comprising a plug (10) with an edge surface (66), the edge surface (66) comprising a plug surface (60) which comprises: a top edge surface (63), a middle edge surface (64), and a bottom edge surface (65);

a seat (20) arranged to support the plug (10);

a breaker object (30) configured to break the plug (10); and wherein the middle edge surface (64) contains a widest portion of the plug (10);

wherein a stabilizer (12) is arranged in direct contact with the middle edge surface (64);

wherein the stabilizer (12) is arranged to at least partially stabilize the plug from twisting or tilting and center the plug (10);

wherein the plug is made of metal, stone, composites, ceramics, or glass; and wherein the stabilizer (12) itself allows fluid to flow through it.

7. The plug assembly (200) according to claim 6, wherein the frangible assembly (15) further comprises a first bearing ring (14), a second bearing ring (14), a first sealing element (11), and a second sealing element (11), all in contact with the plug surface (60), wherein:

the first sealing element (11) is arranged between the first bearing ring (14) and the stabilizer (12); and the second sealing element (11) is arranged between the second bearing ring (14) and the stabilizer (12).

8. The plug assembly (200) according to claim 7, further comprising a sealing area (13), wherein the sealing area (13) is a region where one or both of the housing (140) and the seat (20) are in contact with the first sealing element (11) and the second sealing element (11); and wherein, the sealing area (13) is non-parallel with a longitudinal axis of the plug assembly (200).

9. The plug assembly (200) according to claim 6, further comprising a shear ring (50), the shear ring (50) comprising a shear ring lip (51), wherein:

the seat (20) is supported by the shear ring lip (51); and an end of the seat (20) extends past a portion of the shear ring lip (51).

10. The plug assembly (200) according to claim 6, further comprising a breaker assembly (32), the breaker assembly comprising a breaker holder (31), wherein the breaker holder (31) is configured to hold the breaker object (30) fixed in place, and there is a seat pocket (24) between the seat (20) and the breaker assembly (32), wherein at least a portion of the breaker object (30) enters the seat pocket (24), wherein: the plug (10) is in contact with the breaker object (30).

11. The plug assembly (200) according to claim 6, wherein the stabilizer (12) is in contact with both the middle edge surface (64) and the bottom edge surface (65); or both the middle edge surface (64) and the top edge surface (63).

12. The plug assembly (200) according to claim 11, wherein the stabilizer (12) is a continuous element.

13. The plug assembly (200) according to claim 6, wherein the stabilizer (12) is in contact with the bottom edge surface (65), the middle edge surface (64) and the top edge surface (63).

14. The plug assembly (200) according to claim 6, wherein the stabilizer (12) is in contact with the entire middle edge surface (64).

15. The frangible assembly (15) according to claim 6, wherein there is no fluid seal between the middle edge surface (64) and the housing (140).

16. The plug assembly (200) according to claim 6, further comprising a bearing ring (14) arranged between the plug (10) and the seat (20), wherein the bearing ring (14) and the stabilizer (12) are separate elements.

17. A frangible assembly (15) comprising:

a plug (10) with a plug surface (60) which comprises: an edge surface (66), the edge surface (66) comprising a top edge surface (63), a middle edge surface (64), and a bottom edge surface (65);

a first bearing ring (14) in contact with the plug (10);

wherein the plug is made of metal, stone, composites, ceramics, or glass;

wherein the middle edge surface (64) contains a widest portion of the plug (10);

wherein a stabilizer (12) is arranged in direct contact with the middle edge surface (64);

wherein the stabilizer (12) and the first bearing ring (14) are separate elements; and wherein the stabilizer (12) itself allows fluid to flow through it.

18. The frangible assembly (15) according to claim 17, further comprising a first sealing element (11), in contact with the plug surface (60), wherein the first sealing element (11) is arranged between the first bearing ring (14) and the stabilizer (12).

19. The frangible assembly (15) according to claim 18, further comprising a second bearing ring (14') and a second sealing element (11'), the second bearing ring (14') and the second sealing element (11') are in contact with the plug surface (60), wherein: the second sealing element (11') is arranged between the second bearing ring (14') and the stabilizer (12).

* * * * *